US005123167A

United States Patent [19]

Kelley

[11] Patent Number: 5,123,167

[45] Date of Patent: Jun. 23, 1992

[54] KNIFE WITH SHEATH ENGAGEABLE LOCK

[76] Inventor: Gary C. Kelley, 17485 SW. Pheasant La., Aloha, Oreg. 97006

[21] Appl. No.: 676,449

[22] Filed: Mar. 28, 1991

[51] Int. Cl.[5] ..... B26B 29/02

[52] U.S. Cl. ..... 30/151; 30/162; 224/232

[58] Field of Search ..... 30/151, 162; 224/232, 224/233, 242, 226; 24/615, 625; 16/114 R; 403/329, 330

[56] References Cited

U.S. PATENT DOCUMENTS 2,391,574 12/1945 Housinger ..... 30/151
2,793,434 5/1957 Wigington ..... 224/232 X
4,813,108 3/1989 Geldwerth ..... 24/615 X

*Primary Examiner*—Douglas D. Watts
*Assistant Examiner*—Clark F. Dexter
*Attorney, Agent, or Firm*—James D. Givnan, Jr.

[57] ABSTRACT

A sheath knife handle includes an arm member offset from the main portion of the handle and attached to the handle by a flexible segment to permit arm member displacement by pressing with a finger. The arm member includes a latch component which upon inward arm member movement disengages a knife sheath to permit removal of the knife. The knife handle may be equipped with dual arm members to provide a double locking arrangement operable by a gripping action of the thumb and index finger. The arm member additionally defines a recess in which is received the upper edge of the knife sheath.

2 Claims, 1 Drawing Sheet

KNIFE WITH SHEATH ENGAGEABLE LOCK

BACKGROUND OF THE INVENTION

The present invention concerns generally sheath knives of the type lockable within a sheath.

To avoid accidental separation of a knife from its sheath it is common practice to provide a lock or a latch which requires manipulation for knife removal.

Existing latches or locks are not always of a design which renders a knife readily removable from its sheath i.e., compatible with normal finger and hand movement, but rather require awkward manual efforts. Further, some prior art locks for retaining a knife in a sheath undesirably add significant cost to knife manufacture. For example, in the prior art are knives which include spiral springs, pivot pins, push buttons lock components all of which contribute to knife cost of manufacture by reason of additional machining and assembly effort. In the prior art are U.S. Pat. Nos. 4,856,192; 4,558,516; 4,854,044; 2,391,574; 2,901,823; 2,793,434 and 1,237,075 each of which include some of the above noted lock components.

SUMMARY OF THE PRESENT INVENTION

The present invention is embodied in a knife having a latch member carried by a finger displaceable arm integral with the knife handle with latch movement permitted by a flexible segment of the arm.

The latch engages an aperture formed in the knife sheath. Locating of the latch member on the yieldable arm assures knife retention against all but intentional removal. The yieldable arm may flex toward and away from the knife handle under the influence of the user's thumb or, if a dual lock is utilized, the thumb and first finger. Each yieldable arm is a cantilever which is displaceable momentarily for unlatching of the knife from its sheath. The arm has a flexible segment which, under the influence of the thumb or a finger, flexes to the degree the latch is disengaged from a sheath aperture. Locking of the knife in the sheath occurs automatically.

Important objectives of the present invention include the provision of a knife which lends itself to current automated machining and injection moulding techniques to provide a finger actuated latch without use of assembled components which complicate knife construction; the provision of a knife with a dual latch requiring thumb and finger pressure, or in a single latch version, thumb pressure alone; the provision of a knife with a lock (or locks) particularly suited for release by one hand with a natural gripping action of the hand.

DETAILED DESCRIPTION OF THE PREFERRED EMBODIMENTS

Figure 1:
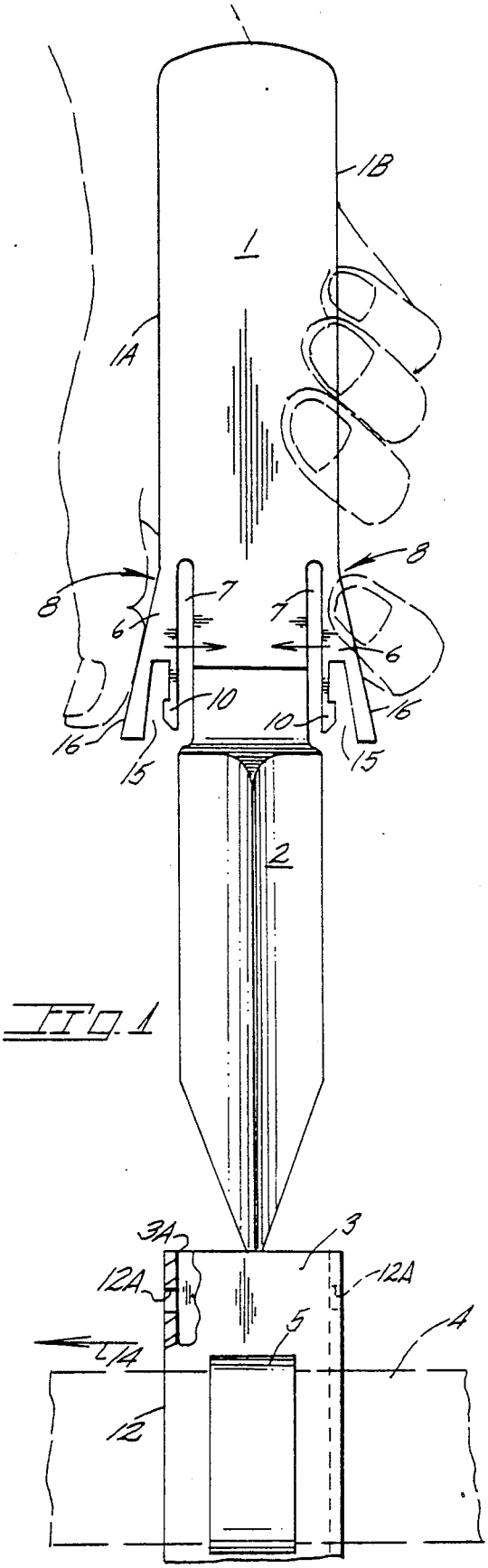
FIG. 1 is a front elevational view of a knife employing the present invention.
Figure 2:
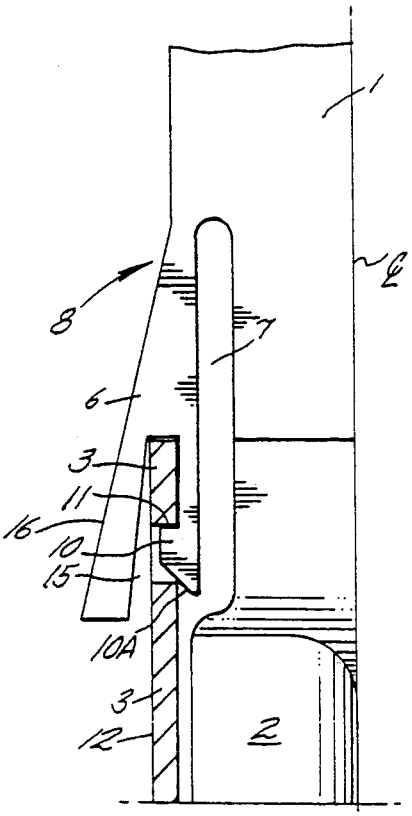
FIG. 2 is an enlarged fragmentary view of a portion of the knife shown in FIG. 1.

With continuing attention to the drawings, the applied reference numeral 1 indicates a handle of the present sheath knife having a blade at 2. A sheath 3 is adapted for attachment to a belt 4 by means of a loop 5. Knife handle 1 may be integral with blade 2 or attached thereto by suitable means.

An arm member 6 is located adjacent the blade receiving end of the handle while a slot at 7 serves to laterally offset the arm member from the handle. A flexible arm segment is indicated generally at 8 embodied in a reduced section of the arm integral with the handle. The crossectional area of flexible segment 8 may vary to achieve the latching action desired. A latch 10 is formed at the distal end of arm member 6. Latch 10 includes a shoulder 11 for abutment with a sheath defined opening edge at 12A located at the forwardly oriented edge 12 of sheath 3 when located along the user's hip. An arrow 14 indicates a forward direction. With attention again to arm member 6, the same has an open or bite area at 15 into which is received the upper extremity of sheath edge 12 to permit seating of latch 10 against sheath opening edge 12A. A gripping surface 16 of the arm member is of a suitable surface area to receive thumb (or finger) exerted pressure for displacement of the arm member inwardly for removal of latch 10 from sheath engagement.

During sheathing of the knife, a beveled edge 10A of the latch engages an upper edge 3A of the sheath. If so desired, the user may use thumb (or thumb and finger on a knife with dual locks) pressure to facilitate sheathing of the knife.

In a sheath knife with a double lock, both a forward or first side edge 1A and a rearward or second side edge 1B of the knife handle are provided with an arm member 6. The terms forward and rearward are in relation to the human body when the sheath is worn on a belt and at the user's side.

The present lock is particularly suited for use by those where knife separation from a sheath is quickly accomplished with only the fingers of one hand as opposed to those locking arrangements where the sheath must be steadied or restrained by a user's hand during knife removal. Accordingly, the present invention is highly suitable for use by scuba divers and parachutists.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is; I claim:

1. A sheath knife for attachment to a user's attire, said knife comprising, a blade having a handle, a sheath for attachment to the user's attire, said sheath having a latch engaging means, an arm member spaced laterally from said handle and defining a slot therebetween into which the arm member may be partially displaced, said arm member including a flexible segment integral with said handle, said arm member further including a distal end supported by said flexible segment, a gripping surface on said arm member adjacent said distal end for application of a finger exerted pressure, a latch on said arm member integral with said flexible segment and located between said slot and said gripping surface, a bite area formed between said gripping surface and said latch for receiving said latch engagement means, said latch being disengagable from said latch engagement means by flexible displacement of the arm member using said finger exerted pressure for releasing the knife from the sheath, and said handle having two side edges located in a plane substantially parallel to the blade, said flexible segment being integral with a first side edge for displacement of said arm member by said finger exerted pressure.

2. The sheath knife claimed in claim 1 additionally including a second arm member identical to the first mentioned arm member and integral with a second side edge of said handle, said first mentioned arm member and said second arm member disposed oppositely on said handle to permit unlatching of the knife from the sheath by said finger exerted pressure on the gripping surface of each arm member applied by the user's thumb and finger.

* * * * *